US006214785B1

(12) United States Patent
Himmrich et al.

(10) Patent No.: US 6,214,785 B1
(45) Date of Patent: Apr. 10, 2001

(54) BLEACH ACTIVATOR GRANULES

(75) Inventors: Johannes Himmrich; Jürgen Cramer, both of Eppstein (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/392,079

(22) Filed: Sep. 8, 1999

(30) Foreign Application Priority Data

Sep. 9, 1998 (DE) ..... 198 41 184

(51) Int. Cl.[7] ..... C11D 17/00; C11D 3/00; C11D 7/54; A62D 3/00

(52) U.S. Cl. ..... 510/444; 510/376; 252/186.25

(58) Field of Search ..... 510/444, 376; 252/186.25

(56) References Cited

U.S. PATENT DOCUMENTS

| | | | | |
|---|---|---|---|---|
| 3,163,606 | * | 12/1964 | Viveen et al. | 252/98 |
| 3,789,002 | * | 1/1974 | Weber et al. | 252/99 |
| 4,372,868 | | 2/1983 | Saran et al. . | |
| 4,457,858 | | 7/1984 | Saran et al. . | |
| 5,100,576 | | 3/1992 | Cramer et al. . | |

FOREIGN PATENT DOCUMENTS

| | | |
|---|---|---|
| 0037026 | 10/1981 | (EP) . |
| 0070474 | 1/1983 | (EP) . |
| 0238341 | 9/1987 | (EP) . |
| 0240057 | 10/1987 | (EP) . |
| 0241962 | 10/1987 | (EP) . |
| 0 356 700 | 3/1990 | (EP) . |
| 0374867 | 6/1990 | (EP) . |
| 0 468 824 | 1/1992 | (EP) . |
| 0468824 | 1/1992 | (EP) . |
| WO 94 15010 | 3/1990 | (WO) . |
| WO 94 03395 | 2/1994 | (WO) . |

* cited by examiner

*Primary Examiner*—Yogendra Gupta
*Assistant Examiner*—John M. Petruncio
(74) *Attorney, Agent, or Firm*—Miles B. Dearth; Scott E. Hanf

(57) ABSTRACT

What is claimed are bleach activator granules which are obtained by mixing a bleach activator with a binder and x% by weight of the total amount of a water-soluble polymer, spraying of water which comprises 100–x% by weight of the total amount of the water-soluble polymer, where x is a number from 0 to 100, and subsequent granulation and drying.

12 Claims, No Drawings

BLEACH ACTIVATOR GRANULES

CROSS-REFERENCE TO RELATED APPLICATION

The present invention is described in the German priority application No. 19841184.7, filed Sep. 09, 1998, which is hereby incorporated by reference as fully disclosed herein.

DESCRIPTION OF THE RELATED ART

Bleach activators are important constituents in compact detergents, stain removal salts and dishwashing detergents. At from 40° C. to 60° C., they permit a bleaching result which is comparable with a boil wash, by reacting with hydrogen peroxide donors (in most cases perborates or percarbonates) to release an organic peroxycarboxylic acid.

The bleaching result obtainable depends on the nature and reactivity of the peroxycarboxylic acid formed, on the structure of the bond that is to be perhydrolyzed and on the solubility of the bleach activator in water. A large number of substances are known as bleach activators according to the prior art. These are usually reactive organic compounds having an O-acyl or N-acyl group which, promoted by the residual moisture present, react even in the washing powder mixture with the bleaching agent, such as, for example, sodium perborate, if both components are present unprotected.

To prevent reaction with the bleaching agent and hydrolysis in the presence of alkaline constituents of the detergent, and to ensure sufficient storage stability, the bleach activator is employed in the detergent and cleaner preparations in granulated and coated form.

Numerous auxiliaries and processes have been described in the past for granulating these substances. EP-A-0 037 026 describes a process for producing readily soluble activator granules comprising between 90 and 98% by weight of activator. For this purpose, the pulverulent bleach activator is homogeneously mixed with likewise pulverulent cellulose ethers or starch ethers and then sprayed with water or an aqueous solution of the cellulose ether or starch ether, simultaneously granulated and then dried. Since starch and cellulose derivatives only form a gelatinous mass with water, the flowability and adhesion properties of which are insufficient, the activator granules prepared by the process described in EP-A-0 037 026 only have moderate strength.

According to EP-A-0 070 474, it is possible to prepare similar granules by spray-drying aqueous suspensions comprising the activator and the cellulose or starch ether. However, this does not result in a better strength of the granules. EP-A-0 374 867 describes another process for preparing activator granules, where the activator is initially moistened with water and subsequently mixed with the pulverulent auxiliary, preferably sodium carboxymethylcellulose, and granulated. This process variant achieves better coating of the activator particles with the auxiliary, resulting in better storage stability. However, it does not improve the strength of the granules.

EP-A-0 240 057 and EP-A-0 241 962 describe the use of readily water-soluble film-forming polymers as binders in activator granules. Other constituents of the granules described are salts and, if appropriate, bentonite. The granules described are very brittle and display little abrasion resistance.

The use of polymers which are poorly water-soluble at pH 7 and only readily water-soluble at pH 10 as binders in activator granules, if appropriate in combination with cellulose ethers or starch ethers, is described in EP-A-0 468 824. In this process, the polymer is employed as aqueous dispersion and not as a solution. The resulting disadvantage is a worse distribution of the polymer in the granules, associated with a poorer binding of the activator particles and correspondingly with a reduced strength of the granules.

Activator granules containing organic binders, for example carboxymethylcellulose, and a disintegrant are described in EP-A-0 238 341. The content of disintegrant does not improve the strength of the granules. At elevated atmospheric humidity it is observed that the granules even disintegrate more easily.

Thus, all the granules and granulation processes described have the disadvantage of a poor abrasion resistance of the activator granules. Since the storage stability of activator granules in detergents and cleaners decreases significantly with an increasing proportion of fines, a poorer abrasion resistance, during/handling, normal manner naturally results in a poorer storage stability.

The object of the present invention was to improve the abrasion resistance and storage stability of activator granules.

SUMMARY OF THE INVENTION

Surprisingly, it has been found that the abrasion resistance and storage stability of granules comprising bleach activators and binders can be improved significantly by addition of about 1 to 5% by weight of readily water-soluble film-forming, optionally acidic polymers.

The invention provides bleach activator granules, obtained by mixing one or more bleach activators with one or more binders and x% by weight of the total amount of one or more water-soluble polymers, spraying of water which comprises 100–x% by weight of the total amount of the water-soluble polymer, where x is a number from 0 to 100, and subsequent granulation and drying.

DESCRIPTION OF THE PREFERRED EMBODIMENTS

The granules according to the invention are based on customary and known bleach activators, for example from the group consisting of the activated carboxylic esters, carboxylic anhydrides, lactones, acylals, oxamides, N-acylated amines, amides, lactams, acyloxybenzenesulfonates, acylated sugars, and also nitriles or nitrites which carry a quaternary ammonium group, for example N,N,N',N'-tetraacetylethylenediamine (TAED), glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylglucoluril (TAGU), tetraacetylcyanic acid (TACA), di-N-acetyldimethylglyoxime (ADMG) and 1-phenyl-3-acetylhydantoin (PAH). The granules according to the invention may comprise one or more of these bleach activators.

The amount of bleach activator, based on the finished dry granules, is from 50 to 99, preferably from 70 to 98, in particular from 80 to 95%, by weight.

Suitable binders are cellulose and starch and their ethers or esters, for example carboxymethylcellulose (CMC), methylcellulose (MC) or hydroxyethylcellulose (HEC), and the corresponding starch derivatives or mixtures thereof. The amount of binder, likewise based on the finished granules, can be from 1 to 45, preferably from 3 to 10%, by weight.

The two pulverulent components bleach activator and binder can be mixed in customary mixing devices operating batch-wise or continuously, which are generally fitted with rotating mixing implements, for example in a ploughshare mixer. Depending on the effectiveness of the mixing device, the mixing times for a homogeneous mixture are generally between 30 seconds and 5 minutes.

This mixture is subsequently moistened with an aqueous solution of one or more polymers at temperatures of from about 20 to 80° C. Polymers which are suitable for this purpose are all types of organic polymers insofar as they are water-soluble. Particularly suitable polymers are polyacrylic acid, polymaleic acid or fully copolymers of acrylic acid and maleic acid in partially or completely neutralized form. The amount of water-soluble polymer and its concentration in the aqueous solution is adjusted such that the proportion of the polymer in the finished granules is approximately from 0.1 to 10, preferably from 0.5 to 7, in particular from 1 to 5%, by weight and the water content of the mixture during granulation is approximately from 10 to 30, preferably from 15 to 20%, by weight.

This mixture is then granulated, preferably in the same aggregate which has previously been used to mix the components.

The water content of the resulting granules is subsequently reduced to below 2, preferably below 1%, by weight. The excess water can be removed by drying with input of heat, where the temperature of the granules advantageously does not exceed 100° C. and is below the melting point of the bleach activator. Suitable dryers are those which do not adversely affect the granular structure of the product, for example tray dryers, vacuum dryers or fluidized-bed dryers.

The coarse material and fine fractions are separated off from the dried granules by screening. The fraction of coarse material is comminuted by grinding and recycled into the dryer. The fraction of fines is transferred back into the mixer and regranulated. The particle size of the granules prepared in this manner is generally in the range from 100–2000 $\mu$m, preferably 300–1800 $\mu$m. The bulk density is in the range from 450 to 600 g/l.

An increase in the bulk density can be achieved by compacting the granules to give bigger agglomerates, for example in roller compactors, and subsequently comminuting them with the aid of mills, toothed-disk rollers and/or sieves to the desired particle size. The granules which are obtained after these operations have bulk densities of more than 600 g/l.

According to a variant of the above-described process, it is also possible to mix the total amount of the water-soluble polymer in dry form with the bleach activator and the binder, and then to moisten this mixture with water alone, followed by granulation. According to another variant, it is also possible to proceed such that only some of the total water-soluble polymer required is mixed in dry form with the other two components, and the remainder of the water-soluble polymer is applied as aqueous solution.

The granules according to the invention obtained in this way are suitable for direct use in detergents and cleaners. In a particularly preferred use form, they can, however, be provided with a coating sheath by processes known per se. To this end, the granules are coated with a film-forming substance in an additional step, as a result of which the product properties can be significantly influenced.

Suitable coating materials are all film-forming substances, such as waxes, silicones, fatty acids, soaps, anionic surfactants, nonionic surfactants, cationic surfactants and anionic and cationic polymers.

Preference is given to using coating substances having a melting point of 30–100° C. Examples of these, and also a process for application, are described in EP-A-0 835 926. The application of the coating materials is generally carried out by spraying the coating materials which are molten or dissolved in a solvent. The coating material can be applied in amounts of from 0 to 20% by weight, preferably from 1 to 10% by weight, based on the total weight, to the core of the granules according to the invention.

By using these coating materials, it is possible to influence inter alia the reaction kinetics in a specific manner, in order thus to stop interactions between the bleach activator and the enzyme system at the start of the washing process. Moreover, suitable coating can further improve the storage stability.

Furthermore, the granules according to the invention may comprise other suitable additives, such as anionic and nonionic surfactants, which contribute to a more rapid dissolution of the granules according to the invention. Preferred anionic surfactants are alkali metal salts, ammonium salts, amine salts and salts of amino alcohols of the following compounds: alkyl sulfates, alkyl ether sulfates, alkylamide sulfates and alkylamide ether sulfates, alkylaryl polyether sulfates, monoglyceride sulfates, alkylsulfonates, alkylamidesulfonates, alkylarylsulfonates, $\alpha$-olefinsulfonates, alkylsulfosuccinates, alkyl ether sulfosuccinates, alkylamidesulfosuccinates, alkylsulfoacetates, alkylpolyglycerol carboxylates, alkyl phosphates, alkyl ether phosphates, alkylsarcosinates, alkylpolypeptidates, alkylamidopolypeptidates, alkylisethionates, alkyltaurates, alkyl polyglycol ether carboxylic acids or fatty acids such as oleic acid, ricinoleic acid, palmitic acid, stearic acid, copra oil acid salt or hydrogenated copra oil acid salts. The alkyl radical of all of these compounds normally contains 8–32, preferably 8–22, carbon atoms.

Preferred nonionic surfactants are polyethoxylated, polypropoxylated or polyglycerylated ethers of fatty alcohols, polyethoxylated, polypropoxylated and polyglycerylated fatty acid esters, polyethoxylated esters of fatty acids and of sorbitol, and polyethoxylated or polyglycerylated fatty amides.

Other suitable additives are substances which influence the pH during storage and use. These include organic carboxylic acids or salts thereof, such as citric acid in anhydrous or hydrated form, glycolic acid, succinic acid, maleic acid or lactic acid. Further possible additives are those which influence the bleaching power, such as complexing agents and transition metal complexes, for example iron-, cobalt- or manganese-containing metal complexes, as described in EP-A-0 458 397 and EP-A-0 458 398.

Other possible additives are substances which react in the washing liquor with the peroxycarboxylic acid released from the activator and form reactive intermediates, such as dioxiranes or oxaziridines, and can increase the reactivity in this manner. Corresponding compounds are ketones and sulfonimines according to U.S. Pat. No. 3,822,114 and EP-A-0 446 982.

The amount of additive depends in particular on its nature. Thus, acidifying additives and organic catalysts for increasing the performance of the peracid are added in amounts of from 0 to 20% by weight, in particular in amounts of from 1 to 10% by weight, based on the total weight, but metal complexes are added in concentrations in the ppm range.

The granules according to the invention have very good abrasion resistance and storage stability in pulverulent detergent, cleaner and disinfectant formulations. They are ideally suited for use in heavy-duty detergents, stain removal salts, dishwashing detergents, pulveruient multi-purpose cleaners and denture cleaners.

In these formulations, the granules according to the invention are in most cases employed in combination with a source of hydrogen peroxide. Examples of these are perborate monohydrate, perborate tetrahydrate, percarbonates and also adducts of hydrogen p eroxide with urea or amine oxides.

In addition, the formulation, in accordance with the prior art, can have further detergent constituents, such as organic and inorganic builders and cobuilders, surfactants, enzymes, brighteners and perfume.

The considerably improved abrasion resistance achieved by combining the starch, cellulose, starch derivatives and cellulose derivatives, used as binders, with readily water-soluble polymers is presumably due to the different binding mechanisms of the two substance classes, which apparently enhance each other synergistically. In the prior art, there is no indication of this advantageous behavior of the above binder combination.

In contrast to the granules according to EP-A-0 238 341, no higher reaction kinetics in the sense of a disintegrant action were observed for the activator granules according to the invention. Moreover, such a disintegrant action should be actively avoided, since it may lead to a deterioration of the strength of the granules even in the presence of increased atmospheric humidity.

The readily water-soluble polymers according to the present invention are highly water-soluble both at pH 7 and at pH 10. Consequently, the polymers can be introduced into the granules via a solution phase, which is a precondition for the very fine and homogeneous mixture, with the starch, cellulose, the starch derivatives or cellulose derivatives used as binders, which is required for the synergistic enhancement of the strength of the granules.

The examples below serve to illustrate the invention in more detail without limiting it.

EXAMPLES

Preparation and Use Examples

Example 1

Batch-wise Preparation

In a ploughshare mixer M5R, from Lodige, 15 kg of a mixture of 95% by weight of tetraacetylethylenediamine (TAED) and 5% by weight of ®Tylose CR 1500 G2 (carboxymethylcellulose) were mixed intensively at a mixer speed of 90 rpm for a period of 10 min.

In the same ploughshare mixture, at a mixer speed of 90 rpm, 20% by weight, based on the total mixture, of an aqueous solution comprising 10% by weight of ®Sokalan CP 45 (partially neutralized copolymer of acrylic acid and maleic acid) and 90% by weight of water were sprayed at room temperature on the powder pre-mix for a period of 10 min, and mixing was continued for another 2 min, followed by granulation.

The moist granules were then transferred into a fluidized-bed dryer and dried to a residual water content of 2% using gas inlet temperatures of 100° C.

This gave 9.4 kg of granules having a particle size distribution of 200–1600 μm (yield: 60%) and 3.9 kg of fines <200 μm (25%), which were worked up by regranulation, and 2.3 kg of coarse material >1600 μm (15%), which was worked up by grinding. The granules having a particle size of 200–1600 μm have a bulk density of 480 g/l.

Example 2

Continuous Preparation

In a continuous ploughshare mixer KT-160, from Drais, tetraacetylethylenediamine (238 kg/h) and ®Tylose CR 1500 G2 (12 kg/h) were introduced via gravimetric metering devices and mixed homogeneously in the introduction area at a mixer speed of 90 rpm and a blade speed of 2000 rpm. In the middle section of the mixer, 50 l/h of a solution comprising 10% by weight of ®Sokalan CP 45 and 90% by weight of water were added directly onto a rotating blade head by means of a pump. In the rear section of the mixer, the moist product was granulated, discharged into a fluidized-bed dryer and dried there continuously using gas inlet temperatures of 100° C. After drying, the crude granules were screened between 200 μm and 1600 μm. This gave 70% by weight of target particles (200–1600 μm), 20% of coarse particles (>1600 μm) and 10% of fine particles (<200 μm). The bulk density of the granules obtained as target particles is 500 g/l.

Example 3

Subsequent Compaction 10 kg of the target particle granules prepared in Example 2 and having a bulk density of 500 g/l were compacted in a roller compactor Pharmapaktor (from Bepex (Germany)) using a pressing force of 50–60 kN to give scabs, which were then comminuted in a two-step grinding process, pre-grinding using toothed-disk rollers (from Alexanderwerk (Germany)) and comminuting in a sieve (from Frewitt (Germany)) at a mesh size of 2000 μm. The crude granules obtained were 7.2 kg of granules of the target particle size 200–1600 μm (yield: 72%), 1.7 kg of fines <200 μm (17%) which can be recycled by renewed compaction, and 1.1 kg of coarse particles >1600 μm (11%), which can be worked up by regrinding. The target particle granules obtained in this manner have a bulk density of 640g/l.

Example 4

Subsequent Coating 1.5 kg of the target particle granules prepared in Example 2 were initially charged in a ploughshare mixer M5R (from Lödige) and, while being mixed at a mixer speed of about 90 rpm, sprayed with 170 g of a stearic acid melt of a temperature of 800° C. During the coating step, the temperature of the content of the mixture was maintained at 50° C. using a heater mantle. The time for coating and tempering was about 10 min.

Determination of the abrasion resistance of the granules (ball mill abrasion method)

The abrasion resistance of three different types of granules was determined using the following method: the activator granules to be examined are initially freed of particle fractions >1.6 mm and <0.4 mm via vibration screening (2 min). 50+/−0.01 g of the resulting granule material having particle sizes between 1.6 mm and 0.4 mm are filled into a cylindrical ball mill container made of metal and having a diameter of 11.5 cm (upper rim) and a height of 10 cm. To this end, 8 steel balls having a diameter of 20 mm and a weight of 30.0 g are added. The granules are subsequently ground in the ball mill for a period of 5 min at 100 rpm. After grinding, the particle size fraction <0.4 mm is determined via vibration screening (2 min) and expressed in % of the portion weighed into the ball mill. This value is defined as a measure of the abrasion resistance. Low values mean good abrasion resistance, high values mean poor abrasion resistance.

| Activator granules | Abrasion |
|---|---|
| I | 30% |
| II | 30% |
| III | 15% |

Activator granules I: 92% by weight of TAED, 7% by weight of Tylose CR 1500 G2, 1 % by weight of residual water content, preparation according to EP-A-0 037 026

Activator granules II: 92% by weight of TAED, 7% by weight of Sokalan CP 45, 1% by weight of residual water content Activator granules III: 92% by weight of TAED, 5% by weight of tylose CR 1500 G2, 2% by weight of Sokalan CP 45, 1% by weight of residual water content (granules according to the invention from Example 2)

What is claimed is:

1. Bleach activator granules, comprising bleach activator, binder and water soluble polymer, obtained by first mixing one or more bleach activators with one or more binders and x% by weight of the total amount of one or more water-soluble polymers wherein said water-soluble Polymers are of a type that do not contribute disintegration action of said granules, and after said mixing step, subsequently spraying of water which comprises 100–x% by weight of the total amount of the water-soluble polymer, where x is a number of from 0 to 100, and finally granulation and drying.

2. The bleach activator granules as claimed in claim 1, comprising polyacrylic acid, polymaleic acid or copolymers of acrylic acid and maleic acid in fully or partially neutralized form as water-soluble polymer.

3. The bleach activator granules as claimed in claim 1, comprising one or more compounds selected from the group consisting of the activated carboxylic esters, carboxylic anhydrides, lactones, acylals, oxamides, N-acylated amines, amides, lactams, acyloxybenzenesulfonates, acylated sugars, and also nitriles or nitrites which carry a quaternary ammonium group, as bleach activator.

4. The bleach activator granules as claimed in claim 1, comprising cellulose or starch or their ethers or esters as binders.

5. The bleach activator granules as claimed in claim 1, comprising from 50 to 99% by weight of bleach activator, from 1 to 45% by weight of binder and from 0.1 to 10% by weight of water-soluble polymer.

6. The bleach activator granules as claimed in claim 1, comprising from 0 to 20% by weight of one or more additives.

7. The bleach activator granules as claimed in claim 1, wherein the granules are subsequently compacted.

8. The bleach activator granules as claimed in claim 1, wherein the granules are coated with a coating substance.

9. A process for using the bleach activator granules as claimed in claim 1 comprising incorporating said bleach activator granules in detergents, bleaching agents or disinfectants.

10. Bleach activator granules, comprising bleach activator, binder and water-soluble polymer, which is obtained by first mixing one or more bleach activators with one or more binders and x% by weight of the total amount of one or more water-soluble polymers, wherein said water-soluble polymers are of a type that do not contribute disintegration action of said granules, and after said mixing step, spraying of water which comprises 100–x % by weight of the total amount of the water-soluble polymer, where x is a number of from 0.1 to 10, and finally granulating said sprayed mixture which has a water content of from 10 to 30% by weight, and drying said granules to a water content of below 2%.

11. The bleach activator granules according to claim 10 wherein x is from 0.5 to 7.

12. The bleach activator granules according to claim 11 wherein x is from 1 to 5.

* * * * *